US009714499B2

(12) United States Patent
Faivre et al.

(10) Patent No.: US 9,714,499 B2
(45) Date of Patent: Jul. 25, 2017

(54) LOADER PIVOT ANGLE SENSOR SYSTEM AND METHOD THEREOF WITH LEVER DISCS

(71) Applicant: Deere & Company, Moline, IL (US)

(72) Inventors: Damien Faivre, Apremont (FR); Ignacio Alonso Martinez, Saltillo (MX); Andreas Wehle, Nussloch (DE)

(73) Assignee: Deere & Company, Moline, IL (US)

( * ) Notice: Subject to any disclaimer, the term of this patent is extended or adjusted under 35 U.S.C. 154(b) by 7 days.

(21) Appl. No.: 14/739,653

(22) Filed: Jun. 15, 2015

(65) Prior Publication Data

US 2015/0275472 A1 Oct. 1, 2015

Related U.S. Application Data

(63) Continuation of application No. 14/045,240, filed on Oct. 3, 2013, now Pat. No. 9,085,869.

(30) Foreign Application Priority Data

Oct. 30, 2012 (DE) ..... 10 2012 021 191

(51) Int. Cl.
*E02F 3/84* (2006.01)
*E02F 3/34* (2006.01)
(Continued)

(52) U.S. Cl.
CPC ..... *E02F 3/845* (2013.01); *E02F 3/3408* (2013.01); *E02F 3/431* (2013.01); *E02F 9/006* (2013.01); *E02F 9/264* (2013.01)

(58) Field of Classification Search
CPC ..... E02F 3/845; E02F 9/264
See application file for complete search history.

(56) References Cited

U.S. PATENT DOCUMENTS 9,085,869 B2 7/2015 Faivre
9,115,483 B2 * 8/2015 Sakuda et al. ..... E02F 9/264
(Continued)

FOREIGN PATENT DOCUMENTS

CA 2635148 12/2008
DE 102007029795 1/2009
(Continued)

OTHER PUBLICATIONS

First Office Action from the State Intellectual Property Office of China for Application No. 201310526292.8 dated Dec. 26, 2016 (3 pages).

*Primary Examiner* — Gerald McClain
(74) *Attorney, Agent, or Firm* — Michael Best & Friedrich LLP

(57) ABSTRACT

A loader includes a tool carrier arranged on a loader boom. The tool carrier is connected at a first pivot point to the loader boom and at a second pivot point to a pivot linkage. The pivot linkage has first and second links which are pivotably connected to one another at a first link point. The first link is pivotably connected at a second link point to the loader boom, and the second link is pivotably connected at a second link point at the second pivot point to the tool carrier. A sensor senses a pivot angle between the tool carrier and loader boom. The sensor is positioned in a cavity on the loader. An actuating device is connected to the sensor.

5 Claims, 6 Drawing Sheets

(51) Int. Cl.

| | |
|---|---|
| ***E02F 3/43*** | (2006.01) |
| ***E02F 9/26*** | (2006.01) |
| ***E02F 9/00*** | (2006.01) |

(56) References Cited

U.S. PATENT DOCUMENTS

| | | | | |
|---|---|---|---|---|
| 2006/0085116 | A1* | 4/2006 | Suzuki et al. | E02F 9/264 701/50 |
| 2011/0301781 | A1* | 12/2011 | Karlsson et al. | E02F 9/264 701/1 |
| 2014/0119870 | A1 | 5/2014 | Martinez et al. | |
| 2015/0098786 | A1* | 4/2015 | Subrt | E02F 9/264 414/697 |

FOREIGN PATENT DOCUMENTS

| | | | | |
|---|---|---|---|---|
| JP | S64-57150 | U | * | 4/1987 |
| JP | 01090324 | A | * | 4/1989 |
| JP | S6457150 | | | 4/1989 |
| JP | S6490324 | | | 4/1989 |
| JP | H0312948 | | | 2/1991 |
| JP | 03194637 | | | 8/1991 |
| JP | 06228989 | | | 8/1994 |
| JP | 06228989 | A | * | 8/1994 |
| JP | H06-102905 | B2 | * | 12/1994 |
| JP | H06102905 | | | 12/1994 |
| JP | H072553 | | | 1/1995 |
| JP | 2000054423 | | | 2/2000 |
| JP | 2000054423 | A | * | 2/2000 |
| JP | 2000170218 | | | 6/2000 |
| JP | 2000170218 | A | * | 6/2000 |
| JP | 2004278288 | | | 10/2004 |
| JP | 2004278288 | A | * | 10/2004 ..... E02F 9/264 |
| JP | 2007063820 | | | 3/2007 |
| JP | 2007063820 | A | * | 3/2007 |
| JP | 2009052287 | | | 3/2009 |
| JP | 2009052287 | A | * | 3/2009 |
| RU | 2009295 | | | 3/1994 |
| SU | 789377 | | | 11/1980 |
| WO | 2007009207 | | | 1/2007 |

* cited by examiner

LOADER PIVOT ANGLE SENSOR SYSTEM AND METHOD THEREOF WITH LEVER DISCS

CROSS REFERENCE TO RELATED APPLICATION

This application is a Continuation of U.S. patent application Ser. No. 14/045,240, filed 3 Oct. 2013, the full disclosure of which is hereby incorporated by reference herein.

FIELD

The present disclosure relates to a loader having a tool carrier arranged on a loader boom.

BACKGROUND

Loaders, such as for example front loaders, wheeled loaders, telescopic loaders, rear loaders and the like, are known. It is also known for such loaders to be equipped with a sensor device which senses a pivot angle of a tool carrier or tool arranged on the loader, wherein the pivot angle indicates a pivoting position of the tool carrier in particular relative to a loader boom or a jib of the loader. The arrangement of a sensor device on the loader is often difficult or cumbersome because the sensor may be subjected to considerable loads, and in particular must withstand contamination and damage caused by load material and must be of correspondingly robust design or positioned in a protected manner. For example, magnetostrictive sensors are arranged directly on a lifting cylinder of the loader, to measure the stroke of the cylinder and determine the pivot angle at the tool. Magnetostrictive sensors are generally cumbersome to install and are also expensive. Alternatively, it is known to arrange rotational angle or rotation sensors on the loader, for example on the loader boom, on the tool carrier or on the pivot linkage of the loader. Here, there is the problem that additional protection must be provided for the sensor, for example by means of a robust cover. Such a cover may restrict a view of the tool, requires additional assembly and is costly.

SUMMARY

According to an aspect of the present disclosure, a front loader includes a sensor which is positioned in a cavity on the loader, and an actuating device is provided which is connected to the sensor and which extends in the cavity and which is connected to a pivot pin, arranged at the second link point, of the first link. The pivot pin is connected rotationally coupled to the first link. Because the sensor is arranged in a cavity on the loader, the sensor is protected against external influences, or automatically covered, so that external objects cannot contact the sensor. Furthermore, assembly is simple because no additional covers are required. Preferably, the cavity is close to the pivot linkage, so that the actuating device can be of compact design, and a pivoting movement directly at the tool carrier or at the pivot linkage can be sensed. In this way, inaccuracies are avoided, and error tolerances can be kept small. The sensor may, for example, be a magnetic, potentiometric or optical rotational angle sensor or rotary sensor or rotation sensor.

The cavity may be formed in the loader boom, for example close to the pivot linkage. It is thus possible for the loader boom or a jib to be hollow, so that the opening is formed as a cutout in a hollow wall. Through corresponding positioning and design of the opening, assembly is also made simple and uncomplicated. A cable arrangement for the sensor may also be guided through the interior of the hollow profile, thus providing protection for the sensor and for the cable arrangement against externally-induced damage. Alternatively, the sensor could also be positioned in a cavity of the pivot linkage or of the tool carrier, for example between two spaced-part links or support plates, wherein the opening is formed either by a cutout on the links or support plates or by the spacing of the links or support plates to one another.

The actuating device includes a rotary axle which is connected to the sensor, a first rotary lever which is connected rotationally coupled to the axle, a second rotary lever which is connected rotationally coupled to the pivot pin, and a control arm. The control arm pivotably connects the first rotary lever to the second rotary lever so that a rotational movement of the pivot pin is transmitted by the second rotary lever via the control arm to the first rotary lever and thus to the sensor. Here, the axle serves as a rotational angle encoder or transmitter for the sensor and may be connected to the sensor directly or indirectly, for example by means of a rotational transmission means. The first rotary lever is a rigid connecting arm which extends radially. The first rotary lever thus transmits a movement imparted at the first rotary lever directly to the rotary axle of the sensor. The second rotary lever is a rigid connecting arm which extends radially with respect to the axle. The second rotary lever thus transmits a rotational movement performed at the pivot pin to the control arm. By means of a control arm, which is a pivotable link or a connecting rod, a rotation of the pivot pin is consequently converted into a rotational movement of the rotary axle at the sensor.

The second rotary lever may be a transverse pin which extends through a transverse bore in the pivot pin. The transverse pin may for example be guided through the transverse bore and held in the transverse bore by a securing means, for example a circlip. The transverse pin may however also comprise a thread by means of which it is screwed into a thread of the transverse bore.

According to the invention, the loader may be a front loader, wheeled loader, telescopic loader or rear loader. The loader boom is a loader boom of a front loader or wheeled loader, or as a jib of a telescopic loader or rear loader. Front loaders and rear loaders may be used as attachment units on agricultural tractors or construction machines. The expression "loader" is also intended to encompass other loader-like assemblies and machines which have a loader boom or a jib, for example construction machines such as diggers, bulldozers or forestry machines for deforestation of woodland, or if appropriate also cranes.

DETAILED DESCRIPTION OF THE DRAWINGS

Figure 1:
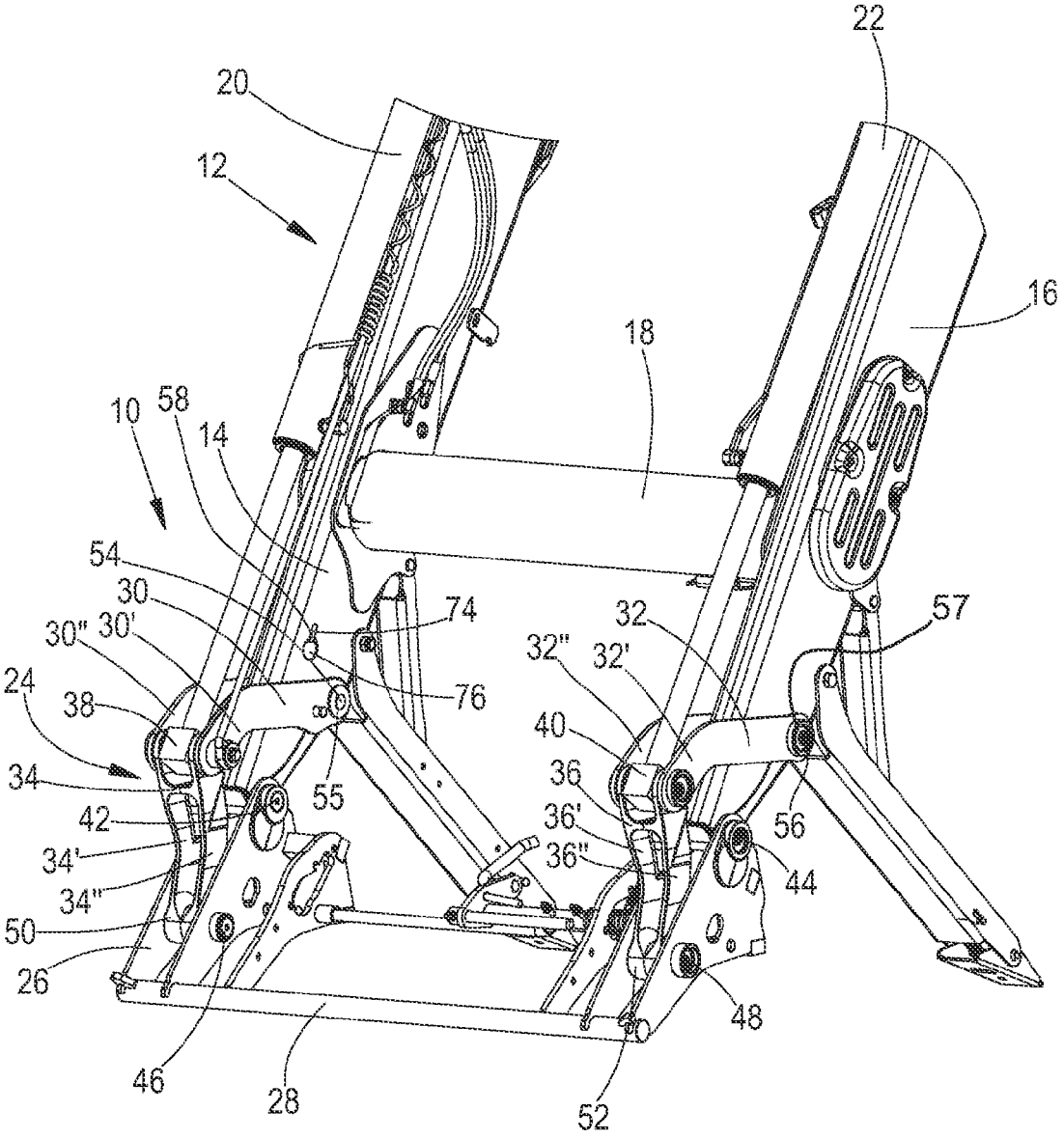
FIG. 1 is a perspective front view of a loader for the front region of a loader boom.

FIG. 1 shows a part of a loader 10 in the form of a front loader. The front loader is operated in combination with a carrier vehicle, for example an agricultural tractor (not shown), and is normally used in the field of agriculture and construction machinery. In the case of a loader 10 being fixedly (non-detachably) mounted on a carrier vehicle, this is referred to as a wheeled loader, but within the context of this invention this is substantially equivalent to a carrier vehicle with a detachably mounted loader 10 (front loader).

The loader 10 comprises a loader boom 12 or jib. The loader boom 12 includes a first and a second boom part 14, 16 which are guided parallel to one another and are connected to one another by means of a crossbeam 18. The loader boom 12 or the jib may however also comprise only one boom part, such as may be the case for example in telescopic loaders, cranes, diggers or forestry machines.

The loader boom 12 also comprises a first and a second lifting cylinder 20, 22, to which is connected a pivot linkage 24 with a tool carrier 26 extending transversely with respect to the loader boom 12. The tool carrier 26 may be equipped, via a tool receptacle 28, with a tool (not shown). In the case of wheeled loaders, for example, fixedly installed tools in the form of a scoop may be used, such that a tool carrier 26 may be dispensed with and the pivot linkage 24 engages directly on the tool.

Figure 2:
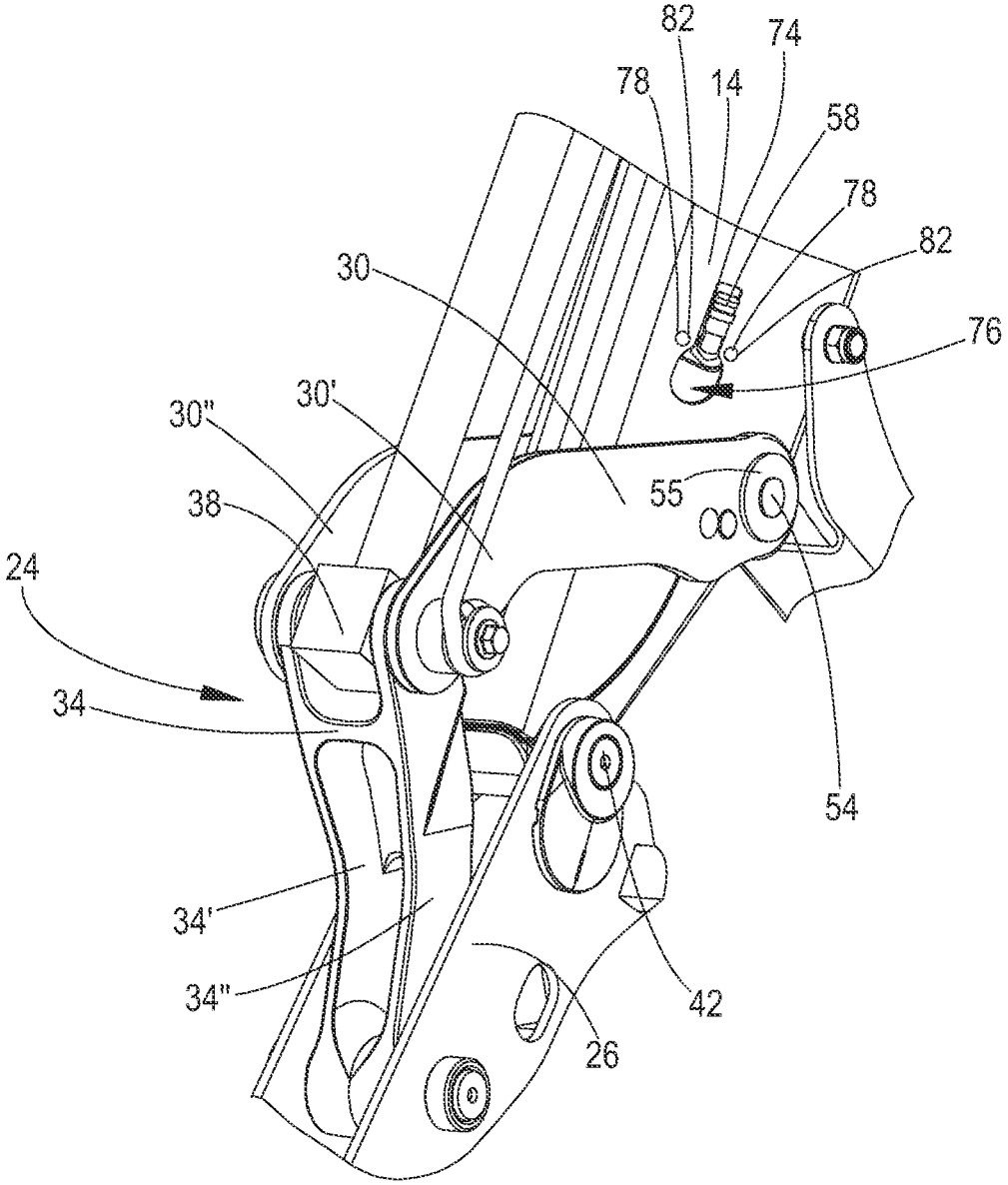
FIG. 2 is an enlarged perspective side view of a pivot linkage portion of the loader of FIG. 1.
Figure 3:
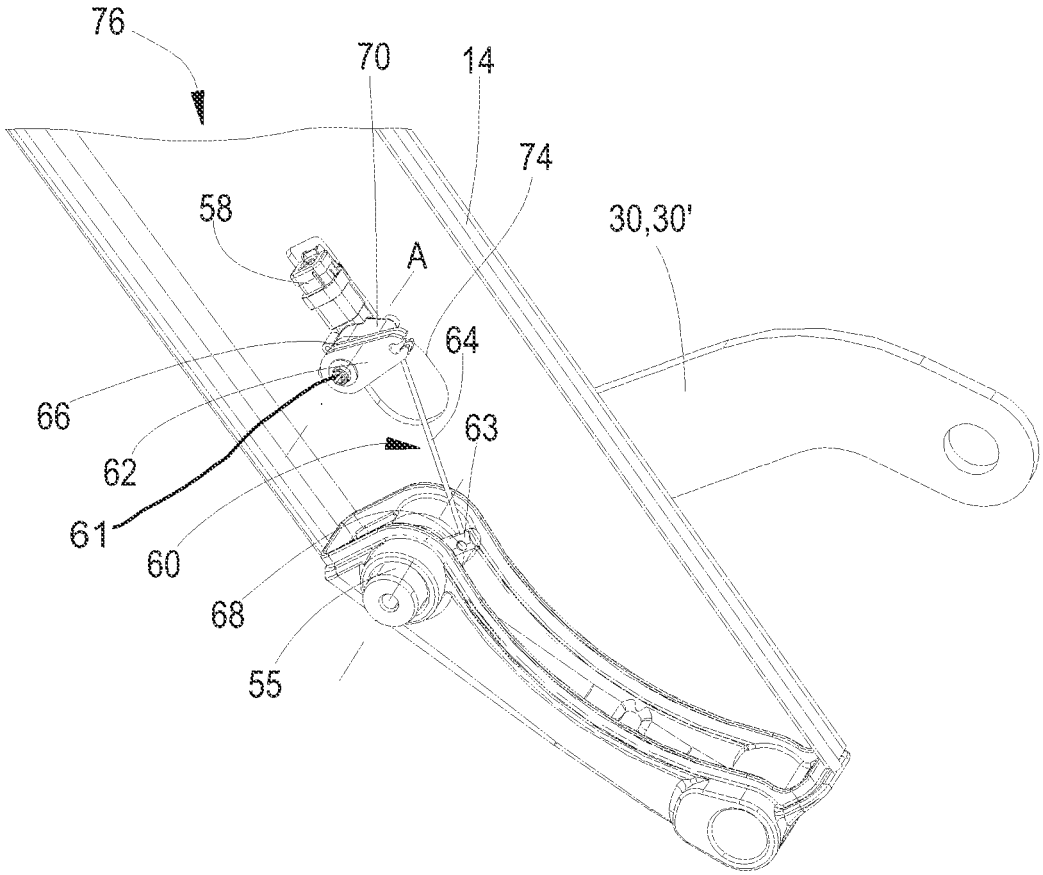
FIG. 3 is a perspective front side view of the outer, partially open side of the loader boom of FIG. 2.

Referring to FIG. 2, the pivot linkage 24 includes, at both sides of the loader boom 12, that is to say on each boom part 14, 16, a first link 30, 32 and a second link 34, 36, these being articulatedly connected to one another at a first link point 38, 40, wherein the lifting cylinders 20, 22 engage on the first link point 38, 40. For dynamic and static reasons, the links 30, 32, 34, 36 are normally flat members spaced apart from one another in pairs, so that, at both sides of the loader boom 12, the pivot linkage 20 comprises a flat member pair 30', 30", 32', 32", 34', 34" and 36', 36" for each of the links 30, 32, 34, 36. The links 30, 32, 34, 36 may however also be arranged as single-piece links 30, 32, 34, 36 (flat member pairs 30', 30", 32', 32", 34', 34" and 36', 36" not arranged in pairs).

The tool carrier 26 has, at both sides, a first pivot point 42, 44 at which it is pivotably connected in each case to a boom part 14, 16 of the loader boom 12 (pivot point 42 on boom part 14, pivot point 44 on boom part 16). Furthermore, the tool carrier 26 has, at both sides, a second pivot point 46, 48 at which it is connected to the second link 34, 36 in each case at a second link point 50, 52 thereof. At a second link point 54, 56 of the first link 30, 32, said first link is pivotably connected via a pivot pin 55, 57 to a boom part 14, 16 of the loader boom 12, wherein the pivot pin 55, 57 is in each case rotationally coupled with the first link 30, 32. With this arrangement, the tool carrier 26 can be tilted in a controlled manner with defined kinematics by the stated lifting cylinders 20, 22 via the first and second links 30, 32, 34, 36 or via the pivot linkage 24, wherein a certain tilt angle of the tool carrier 26 is associated with a defined pivoting movement of the first and second links 30, 32, 34, 36 (see in particular FIG. 2).

For sensing the pivot angle or tilt angle of the tool carrier 26, a sensor 58 is provided which is connected via an actuating device 60 to the pivot linkage 26, in particular to the first link 30 or to the flat profile 30' thereof. The sensor 58 senses the pivot angle relative to the loader boom 12.

The actuating device 60 includes a rotary axle 61 which defines an axis A, a first rotary lever 62, a second rotary lever 63 and a control arm 64. The first rotary lever is connected rotationally coupled to the rotary axle 61, so that, by actuation of the first rotary lever 62, the axle 61 is rotated and the sensor 58 is actuated. A signal from the sensor may be transmitted by a known method, for example by cable or radio (not shown) to a data processor or to a data display (not shown) and is displayed. The axle 61 may be connected directly to the sensor 58 as illustrated, or the axle may be connected to the sensor 58 by a transmission, such as a gearwheel. The control arm 64 is pivotably connected at a joint 66 to the first rotary lever 62. Furthermore, the control arm 64 is pivotably coupled at joint 68 to the second rotary lever 63. The second rotary lever 63 is rotationally coupled connected to the pivot pin 55, which in turn is rotationally coupled connected to the first link 30, 32.

The sensor 58 is mounted on a mounting plate 70. The loader boom 12 has, on its inner side on the boom part 14 in the region of the pivot linkage 24, an opening 74 which, in the wall of the loader boom 12 or of the boom part 14, forms an access to a cavity 76 in the loader boom 12 or of the boom part 14. The opening 74 is keyhole-shaped or formed as a slotted cutout and has fastening bores 78 on its long sides. The opening 74 may alternatively also be rectangular, as a rectangular cutout. The fastening bores 78 are formed as through bores.

The mounting plate 70 is of oval shape, wherein the dimensions of the mounting plate are selected such that the mounting plate 70 can be inserted through the opening 74. On the mounting plate 70 there are provided corresponding fastening bores which overlap the fastening bores 78 at the opening 74. The fastening bores on the mounting plate 70 are equipped with a thread, so that the mounting plate 70 can be fastened to the wall of the loader boom 12, or of the boom part 14, by means of threaded screws 82 (see FIGS. 6 and 10).

Figure 6:
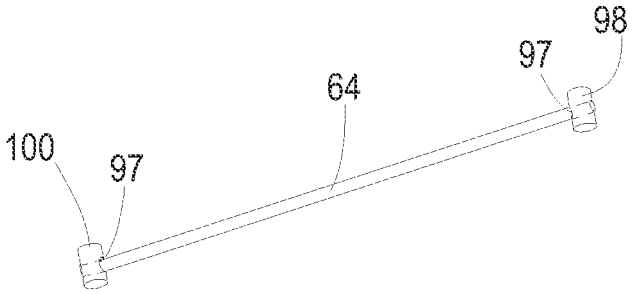
FIG. 6 is a perspective side view of a control arm of an actuating device for the sensor of FIG. 5.
Figure 7:
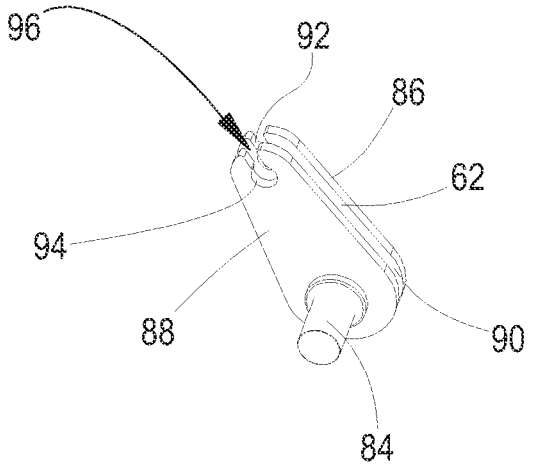
FIG. 7 is a perspective side view of a first rotary lever of the actuating device of FIG. 6.
Figure 8:
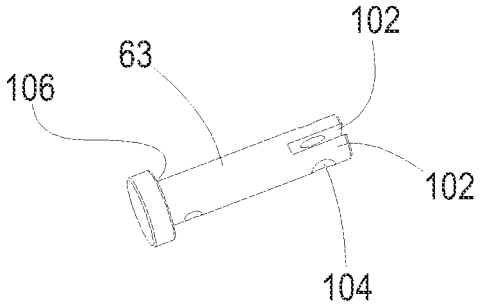
FIG. 8 is a perspective side view of a second rotary lever of the actuating device of FIG. 6.

FIGS. 6 to 8 show the actuating device 60 separated into its individual parts, wherein the actuating device includes the first rotary lever 62, the control arm 64 and the second rotary lever 63. The first rotary lever 62 is connected to the sensor by means of a rotary axle 84 formed on the rotary lever 62. The first rotary lever 62 includes two lever discs 86, 88, between which is formed a gap 90. Furthermore, on both holding discs 86, 88, at one point on the circumference, there are formed recesses 92, 94 which constitute a pin receptacle 96.

The control arm 64 is a rigid bar or rod and has a thread 97 on both of its ends. Furthermore, to both ends of the control arm 64, there are fastened pins 98, 100 which are provided with threaded bores transversely with respect to the control arm 64.

The second rotary lever 63 is a bolt or pin and has, on one end thereof, a fork 102 through which a bore 104 extends, such that a gap 106 formed between the fork 102 extends transversely with respect to the bore 104. At its other end, the second rotary lever has a shoulder 106.

Figure 4:
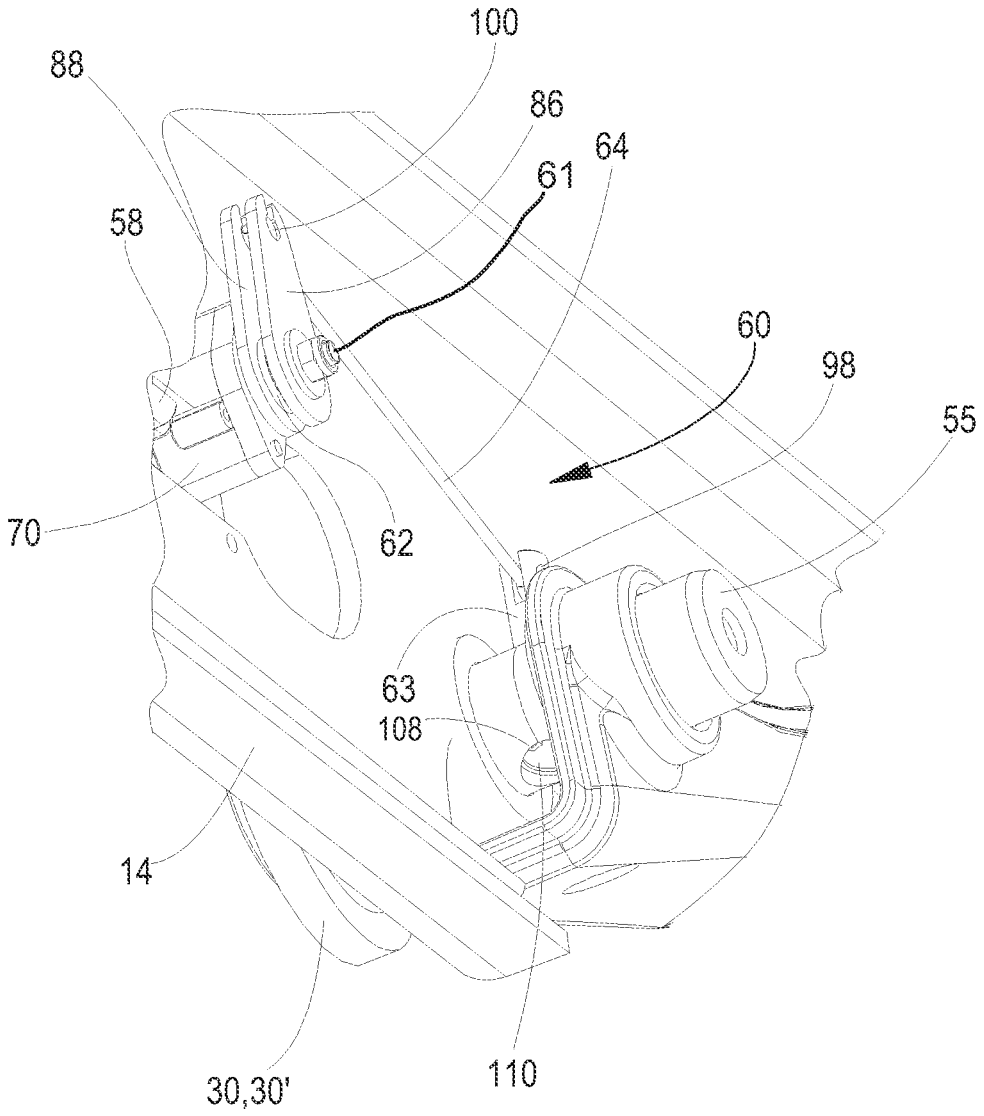
FIG. 4 is a perspective bottom rear side view of the loader boom of FIG. 3.

On the pivot pin 55, too, there is provided a transverse bore 108 which is provided with a shoulder 110 corresponding to the shoulder 106. The diameter of the transverse bore 108 corresponds substantially to the small diameter of the second rotary lever 63. Furthermore, there is formed in the transverse bore 108 an annular groove into which a circlip 110 is inserted (see FIG. 4).

Mounting of the actuating device 60 and of the sensor 58 onto the loading boom 12 takes place in such a way that, firstly, the mounting plate 70 with sensor 58 and first rotary lever 62 is inserted through the opening 74 into the cavity 76, and the mounting plate 70 is positioned transversely with respect to the opening 74, such that the fastening bores 78 (and those in the mounting plate) overlap and the mounting plate 70 bridges the opening in terms of width (in the transverse direction). By means of the threaded screws 82, the mounting plate 70 is fastened to the wall of the loader boom 12 or of the boom part 14, wherein the threaded screw heads are situated outside the cavity 76, on the outer side of the wall, and the mounting plate 70 with sensor 58 and first rotary lever 62 are situated within the cavity 76, on the inner side of the wall. Next, the remaining parts of the actuating device 60 are pre-mounted by virtue of the pin 98 of the control arm 64 being inserted into the bore 104 of the second rotary lever. Subsequently, the control arm 64 is screwed to the pin 98, such that the control arm 64 is pivotably mounted in the fork 102. The second pin 100 is likewise connected to the control arm 64. The control arm 64 and the pins 98, 100 fastened thereto, and also the second rotary lever 63, are then inserted through a mounting opening 112 below the pivot pin 55 (see FIG. 4) and passed through the transverse bore 108 of the pivot pin 55. After insertion into the transverse bore 108, the circlip 110 is inserted, such that the second rotary lever 63 is secured against axial displacement by the circlip 110 and shoulder 106. Subsequently, via the opening 74, the pin 100 of the control arm 64 is, from the outside, placed in connection with the recesses 92, 94 of the lever discs 86, 88, such that the control arm 62 is pivotably mounted by means of the pin 100 and the gap 90 between the lever discs 86, 88.

Figure 5:
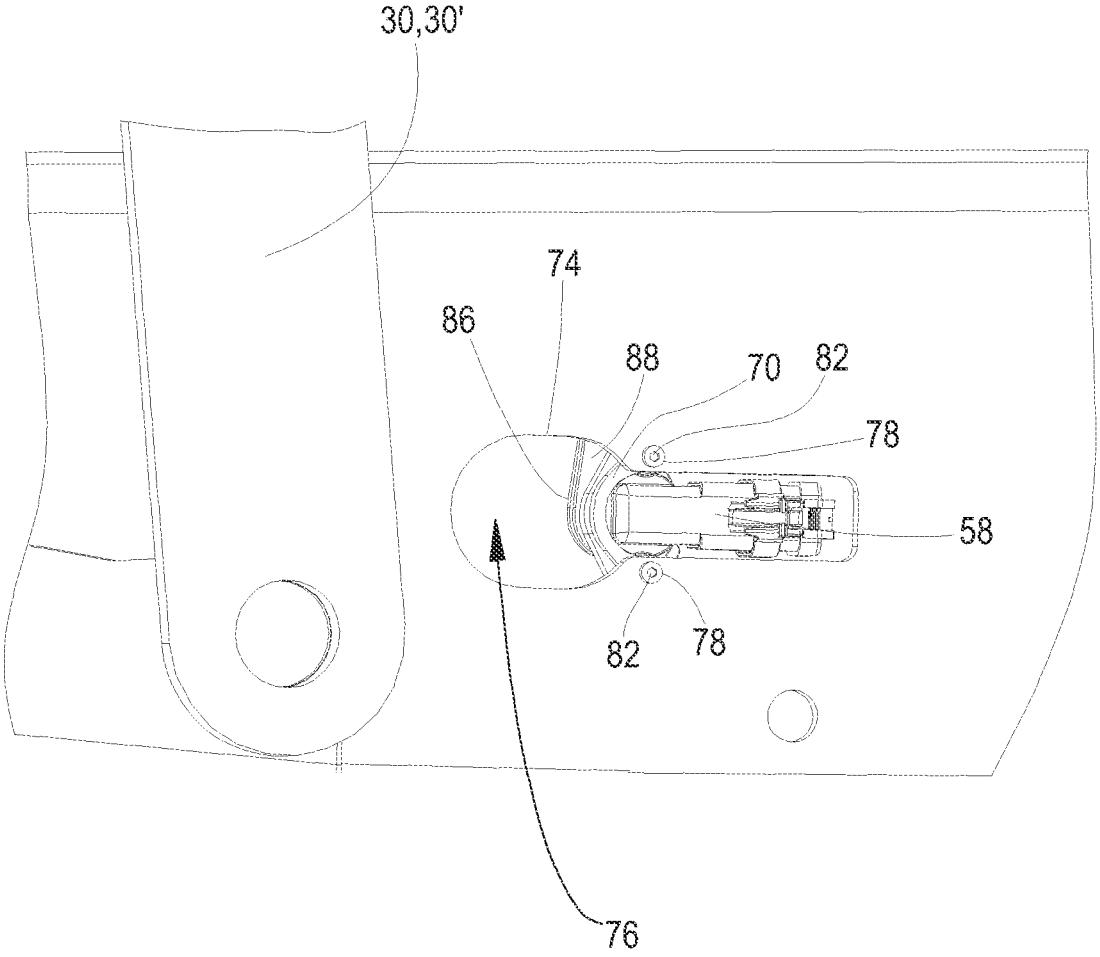
FIG. 5 is an enlarged perspective side view of the inner side the loader boom of FIG. 2.

The sensor 58 is then situated in the cavity 76 of the loader boom 12 (see FIGS. 4 and 5) and is protected against any external influences by the wall of the loader boom 12. The same applies to the actuating device 60 of the sensor 58 and a cable arrangement of the sensor 58, which can be easily passed through the cavity 76.

As a result of connection of the first rotary lever 62 to the pivot pin 55 or to the first link 30, which is connected rotationally coupled to the pivot pin 55, of the pivot linkage, the actuating device 60 is placed in connection with the pivot linkage 24. A pivoting movement of the tool carrier 26 or of a tool fastened thereto is thus transmitted by the first link 30 of the pivot linkage 24 to the second rotary lever 63, from there to the control arm 64, and from there to the first rotary lever 62. The first rotary lever then rotates axle 61 and generates a corresponding pivot angle signal at the sensor 58. Here, the pivot angle signal represents a pivot angle or a change in the pivot angle between the tool carrier 26 and loader boom 12. As a result of the positioning of the sensor 58 close to the pivot linkage 24, measurement errors are kept small. Furthermore, the actuating device 60 can be of compact form with a small design, such that overall, in addition to the protection of the sensor 58 provided by the wall at the cavity 76, a small engagement surface for external objects is provided, and mounting can be realised in a simple manner.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A pivot angle sensor system comprising:

a tool carrier connected at a first pivot point to a loader boom and at a second pivot point to a pivot linkage comprising a first link connected to a second link at a first link point, wherein the first link is connected to the loader boom at a pivot pin and the second link is connected to the tool carrier;

a pivot angle sensor for sensing the angle between the tool carrier and the loader boom, wherein the sensor is within a loader boom cavity; and an actuating device comprising a first rotary lever connected to both the pivot angle sensor and a control arm and a second rotary lever connected to the first link, wherein the first rotary lever comprises two lever discs that form a pin receptacle configured to couple to the control arm, and wherein the second rotary lever is a transverse pin which extends through a transverse bore in the pivot pin and is connected to the first link at the pivot pin.

2. The system of claim 1, wherein the pivot angle sensor is mounted on a mounting plate within a loader boom cavity.

3. A method for determining the angle between a tool carrier and a loader boom comprising:

rotating the tool carrier thereby moving an actuating device connected to the tool carrier;

sensing the movement of the actuating device with a pivot angle sensor that is connected to and housed within the loader boom; and sending a signal from a pivot angle sensor to a data processor to determine the angle between a tool carrier and a loader boom, wherein the tool carrier is connected at a first pivot point to a loader boom and at a second pivot point to a pivot linkage comprising a first link connected to a second link at a first link point, wherein the first link is connected to the loader boom at a pivot pin and the second link is connected to the tool carrier, wherein the actuating device further comprises a first rotary lever connected to both the pivot angle sensor and a control arm and a second rotary lever connected to the first link, wherein the first rotary lever comprises two lever discs that form a pin receptacle configured to couple to the control arm, and wherein the second rotary lever is a transverse pin which extends through a transverse bore in the pivot pin and is connected to the first link at the pivot pin.

4. The method of claim 3, wherein the signal from a pivot angle sensor to a data processor is sent by at least one of a cable and a wireless communication protocol.

5. The method of claim 3, wherein the pivot angle sensor is mounted on a mounting plate within a loader boom cavity.

* * * * *